US010624468B2

(12) United States Patent
Codos

(10) Patent No.: US 10,624,468 B2
(45) **Date of Patent: *Apr. 21, 2020**

(54) PILLOW

(71) Applicant: Richard Codos, Warren, NJ (US)

(72) Inventor: Richard Codos, Warren, NJ (US)

(73) Assignee: SLEEPOVATION LLC, East Hanover, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/259,353

(22) Filed: Jan. 28, 2019

(65) Prior Publication Data

US 2019/0150630 A1 May 23, 2019

Related U.S. Application Data

(63) Continuation-in-part of application No. 14/801,790, filed on Jul. 16, 2015, now Pat. No. 10,188,219, which is a continuation-in-part of application No. 14/695,063, filed on Apr. 24, 2015, now Pat. No. 9,661,932.

(Continued)

(51) Int. Cl.

| | |
|---|---|
| ***A47C 27/06*** | (2006.01) |
| ***A47C 27/05*** | (2006.01) |
| ***A47C 27/04*** | (2006.01) |
| ***A47C 27/07*** | (2006.01) |
| ***A47C 21/04*** | (2006.01) |

(52) U.S. Cl.

CPC ..... *A47C 27/064* (2013.01); *A47C 21/046* (2013.01); *A47C 27/053* (2013.01); *A47C 27/07* (2013.01)

(58) Field of Classification Search

CPC ..... A47C 23/04; A47C 23/043; A47C 23/064; A47C 23/065; A47C 27/04; A47C 27/05; A47C 27/053; A47C 27/056; A47C 27/06; A47C 27/062; A47C 27/064; A47C 27/14; A47C 27/148; A47C 27/15

USPC ..... 5/239, 241, 243, 245, 642, 654.1, 655.7, 5/655.8, 716, 720, 727, 728

See application file for complete search history.

(56) References Cited

U.S. PATENT DOCUMENTS 19,350 A * 2/1858 Crossman et al. ... A47C 27/064 5/720

1,192,510 A 7/1916 Fischmann (Continued)

FOREIGN PATENT DOCUMENTS

| | | |
|---|---|---|
| CN | 103610349 A | 3/2014 |
| EP | 2789267 B1 | 5/2015 |

(Continued)

*Primary Examiner* — Robert G Santos

(74) *Attorney, Agent, or Firm* — Steven N. Fox, Esq.

(57) ABSTRACT

Disclosed is a pillow comprising a plurality of pocket spring units. Each of the pocket spring units comprise a top portion, a bottom portion, and a side portion. The pillow further comprises an attachment layer comprising a top portion comprising an upper surface and a lower surface. The pillow further comprises a plurality of first cushion elements engaged with the upper surface of the top portion of the attachment layer. The bottom surface of the top portion of the attachment element being engaged with the top portion of the plurality of pocket springs units such that each of the first cushion elements act only upon one of the pocket spring units.

8 Claims, 6 Drawing Sheets

Related U.S. Application Data

(60) Provisional application No. 62/134,406, filed on Mar. 17, 2015.

(56) References Cited

U.S. PATENT DOCUMENTS

| | | | | | |
|---|---|---|---|---|---|
| 685,160 | A | | 3/1926 | Marshall | |
| 1,576,738 | A | * | 3/1926 | Fuld | A47C 27/04 5/720 |
| 1,834,546 | A | * | 12/1931 | Micon | A47C 27/05 5/720 |
| 1,906,893 | A | * | 5/1933 | Young | A47C 27/05 5/716 |
| 2,236,007 | A | | 3/1941 | Oldham | |
| 2,983,236 | A | | 5/1961 | Thompson | |
| 3,031,690 | A | * | 5/1962 | Ramsay | A47C 23/002 5/401 |
| 3,122,829 | A | * | 3/1964 | Schaad | A47C 7/34 29/436 |
| 3,160,894 | A | * | 12/1964 | Frey | A47C 23/068 5/243 |
| 3,166,768 | A | | 1/1965 | Cunningham | |
| 3,191,197 | A | * | 6/1965 | Frey | A47C 27/04 5/243 |
| 3,462,779 | A | | 8/1969 | Thompson | |
| 4,439,977 | A | | 4/1984 | Stumpf | |
| 4,566,926 | A | | 1/1986 | Stumpf | |
| 4,899,404 | A | | 2/1990 | Galumbeck | |
| 5,070,560 | A | | 12/1991 | Wilkinson | |
| 5,231,718 | A | * | 8/1993 | Blaha | A47C 27/088 5/719 |
| 5,783,278 | A | | 7/1998 | Nishimura | |
| 5,868,383 | A | | 2/1999 | Codo | |
| 6,041,459 | A | | 3/2000 | Nunez | |
| 6,317,912 | B1 | | 11/2001 | Graebe | |
| 6,397,418 | B1 | | 6/2002 | Stjerna | |
| 6,490,744 | B1 | * | 12/2002 | Schulz, Jr. | A47C 27/063 5/716 |
| 6,523,812 | B1 | | 2/2003 | Spinks | |
| 6,804,847 | B2 | * | 10/2004 | Grothaus | A47C 27/04 5/655.8 |
| 6,948,205 | B2 | | 9/2005 | Van Der Wurf | |
| 7,082,635 | B2 | | 8/2006 | Barman | |
| 7,845,035 | B2 | | 12/2010 | Letton | |
| 8,181,296 | B2 | | 5/2012 | Rawls-Meehan | |
| 8,266,745 | B2 | | 9/2012 | Mossbeck | |
| 8,474,078 | B2 | | 7/2013 | Smossbeck | |
| 8,932,692 | B2 | | 1/2015 | Pearce | |
| 9,661,932 | B2 | * | 5/2017 | Codos | A47C 27/064 |
| 9,949,571 | B2 | * | 4/2018 | Codos | A47C 27/064 |
| 10,098,474 | B2 | * | 10/2018 | Hager | A47C 27/064 |
| 10,188,219 | B2 | * | 1/2019 | Codos | A47C 27/064 |
| 10,368,655 | B2 | | 8/2019 | Codos | |
| 2003/0217413 | A1 | | 11/2003 | Grothaus | |
| 2007/0044245 | A1 | | 3/2007 | Bryant | |
| 2009/0089933 | A1 | | 4/2009 | Lettton | |
| 2010/0325806 | A1 | | 12/2010 | Letton | |
| 2016/0045034 | A1 | * | 2/2016 | Hager | A47C 27/064 5/720 |
| 2016/0270545 | A1 | * | 9/2016 | Codos | A47C 27/064 |
| 2016/0270546 | A1 | * | 9/2016 | Codos | A47C 27/064 |
| 2017/0258242 | A1 | * | 9/2017 | Codos | A47C 27/056 |
| 2019/0150630 | A1 | * | 5/2019 | Codos | A47C 27/07 |
| 2019/0183253 | A1 | * | 6/2019 | Codos | A47C 27/064 |
| 2019/0216241 | A1 | * | 7/2019 | Codos | A47C 21/046 |
| 2019/0343295 | A1 | * | 11/2019 | Codos | A47C 27/064 |
| 2019/0380503 | A1 | * | 12/2019 | Stjerna | A47C 27/064 |

FOREIGN PATENT DOCUMENTS

| | | |
|---|---|---|
| GB | 2452602 | 11/2009 |
| WO | WO1981002384 | 9/1981 |
| WO | WO1991010387 | 7/1991 |
| WO | WO2002039853 | 5/2002 |
| WO | WO2009117631 | 9/2009 |
| WO | WO2014080302 | 5/2014 |
| WO | WO2014166927 | 10/2014 |

* cited by examiner 10
100
20
20
20

PILLOW

CROSS-REFERENCE TO RELATED APPLICATIONS

This application claims priority to and is a continuation-in-part of U.S. Utility application Ser. No. 14/801,790 filed on Jul. 16, 2015, now pending, that claims priority to U.S. Utility application Ser. No. 14/695,063 filed on Apr. 24, 2015, now U.S. Pat. No. 9,661,932, that claims priority to U.S. Provisional Application Ser. No. 62/134,406 filed on Mar. 17, 2015, all of which are hereby incorporated into this specification by reference in their entirety.

BACKGROUND OF THE INVENTION

Pillows on the market today are built in one of several different ways. Firstly, the pillow can be made from a randomly oriented filling material. An example of this construction is a pillow that is composed of randomly oriented polyester fiberfill. This construction is not limited to a randomly oriented polyester fiber, but can also include, but is not limited to, wool, cotton, or other fibers in which the material fibers are oriented in random orientations. It is also possible to construct a pillow from randomly oriented solid structures. This type of construction is consistent with pillows made from small foam blocks that are randomly dispersed inside the pillow casing. The foam elements can be made from, but not limited to, man-made foams such a poly foam or visco-elastic foam, to various types of natural foams such as latex foam. In addition to the random orientation of the foam elements, additionally the foam elements can consist of different sizes and shapes. It is also possible to mix different foam sizes and shapes inside of a single pillow covering to create an additional level of randomness.

A second type of pillow construction is made with one or more layers of sheet filling materials within a pillow casing. Examples of this type of pillow are layered poly foam pillows in which one or more types, as well as one or more layers of poly foam are stacked upon one another and then encased in a pillow cover. The layer(s) of foam material can be either man made, such as polyfoam or visco-elastic foam, or natural such a latex. In addition, the layers of sheet foam material can be cut into different contours to allow them to better fit into different body crevices or conforming contours. Also, part of this group of pillow construction is when one or more of the sheet foam layers are fabricated to have a non-uniform surface. A top layer of convoluted foam falls into this category. This type of non-uniform foam layers allows for increased airflow as against uniform surface sheet foam layer, and well as a more localized pressure reduction versus a standard sheet foam material.

A third type of pillow construction can be formed by the combination of types one and two (hybrid pillow). This type of pillow often encompasses, but is not limited to, a solid foam center surrounded by a randomly oriented fiberfill material. This type of construction has both the advantages and disadvantages of each respective pillow construction.

In all of the aforementioned pillow construction methods several benefits and corresponding shortcomings are evident. In the case of type one, the random fiberfill pillow construction, the random orientation of the filling material fibers allows for an airflow to be able to exist within the fiber construction and hence within the pillow. This allows the sleeper to not overheat when sleeping in a single position over a long period of time since air can flow within the pillow structure and around the sleeper's head. At the same time, the random orientation of the fiber filling allows the sleeper to "mold" the pillow to suit their particular needs. However, the randomness of the fibers, in allowing the pillow to easily mold, also makes the pillows resilience, or bounce back, both unpredictable and potentially compromised. This also results in a pillow that tends to "flatten out" over the course of a night's sleep. Many a sleeper will have to "fluff up" the pillow, by manually attempting to re-randomize the fibers, in an attempt to un-flatten the pillow and restore some of the pillow's original resilience. With regards to the type of construction made from small foam blocks that are randomly dispersed inside the pillow casing similar advantages and disadvantages already discussed also occur. The very nature of random orientation of the foam elements makes the pillow unpredictable in terms of resilience and in term of potentially flattening out.

The advantage of the second type of pillow construction, the uniform sheet layer filled pillow, is that this type of pillow has a uniform resilience and will not flatten out. The problem with the sheet foam pillow construction centers around two principle areas. Firstly, the very nature of sheet foam tends to restrict airflow. Even attempts to mitigate this issue by creating non-uniform, convoluted surfaces, still results in significantly reduced airflows versus non-uniform fiber filled pillows. This is due to the fact that even convoluted foam surfaces have a continuous foam layer beneath the convoluted layer that inhibits airflow. Additionally, the continuous sheet nature of this style of pillow does not allow spot pressure reduction. For instance, if a sleeper buries the side of their face in the pillow, areas of the face that protrude will be subjected to higher localized pressures due to the underlying sheet cushioning material not allowing for localized pressure reductions. Along these same lines, the ability of a solid layer cushioning material pillow to mold to a sleeper's anatomy is significantly reduced and compromised.

SUMMARY OF THE INVENTION

What is needed is a pillow construction that incorporates the cooling and pressure relieving properties of pillow type #1 with the repeatable resilience, lack of body imprint, and lack of randomness of pillow type #2. Therefore, one object of the present invention is to provide a pillow that facilitates a continuous airflow within the pillow body by having passive air channels as part of its construction.

Another object of the invention is to provide uniform blocks of foam, each engaged with its own pocket coil spring, such that the blocks of foam maintain a uniform, non-random, and predictable arrangement that will not be subject to random realignment, thereby insuring consistent pillow resilience with no flattening out.

Another object of the invention is to create a cooling mechanism, via a passive airflow within the pillow body, that can remove excess sleeper's heat when engaged with the pillow.

Another object of this invention is to create an active airflow within the pillow body by creating a matrix of positive displacement air pumps within the pillow cushion layer as the sleeper moves on the pillow, Another object of the invention is to create a pillow body that is capable of supporting airflows associated with breathing and therefor reducing the buildup of carbon dioxide when the sleeper is in a side sleeping, or partial face down position. Since buildup of carbon dioxide triggers a wakeup mechanism, this feature helps insure a better night's sleep and helps mitigate the risks associated with sleep apnea.

Another object of the invention is to help in reducing localized high-pressure interface points, and help in conforming to face contours, by providing dozens of tiny pillows within the one overall pillow.

Another object of this invention is to allow for molding of the pillow body to the sleeper's head shape while still providing adequate and consistent resilience should the sleeper change positions.

Another object of this invention is to create a pillow that has a constant and repeatable resiliency without any tendency fore the pillow to flatten out, Another object of this invention is to provide a mechanism, via an attachment layer, of securing individual foam cushions to individual pocket springs thereby engaging one foam cushion with one pocket spring while at the same time giving out of plane stability to the cushion layer and spring layer, Another object of this invention is to provide a mechanism to secure the individual foam cushions to the sides of pocket coil springs that will provide an out of plane cushion relative to the plane of the pocket coils along the edges of the pillow.

The present in invention is a pillow comprising a plurality of pocket spring units. Each of the pocket spring units comprise a top portion, a bottom portion, and a side portion. The pillow further comprises an attachment layer comprising a top portion comprising an upper surface and a lower surface. The pillow further comprises a plurality of first cushion elements engaged with the upper surface of the top portion of the attachment layer. The bottom surface of the top portion of the attachment element being engaged with the top portion of the plurality of pocket springs units such that each of the first cushion elements act only upon one of the pocket spring units.

BRIEF DESCRIPTION OF THE DRAWINGS

The following description of the present invention will be better understood with reference to the accompanying drawings in which.

DESCRIPTION OF THE INVENTION

Figure 1:
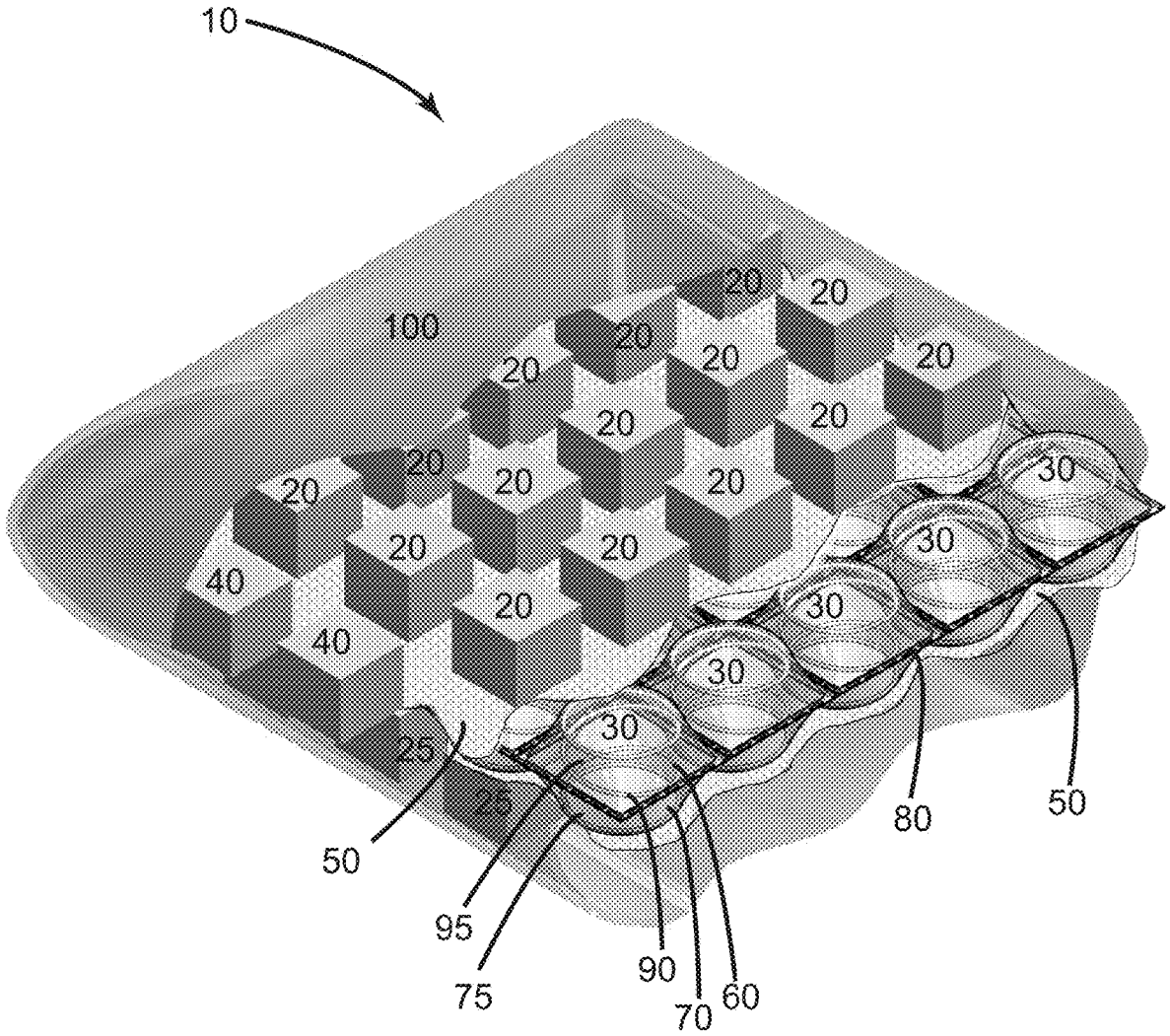
FIG. 1 is a cutaway perspective view of a pillow according to the present invention shown in an unloaded state.

Referring to FIG. 1, where a pillow 10 with a fabric cover 100 is shown according to one embodiment of the present invention. Pillow 10 comprises a plurality of pocket spring units 30 each comprising a pocket 95 and an individual metal barrel springs 90 disposed within pocket 95. Pocket 95 has a top portion 60, a bottom portion 70, and a side portion 75. Pocket 95 is made from a piece of non-woven fabric 60 (shown in transparent state for ease of viewing pocket insides), and a piece of non-woven fabric 70, (shown in transparent state for ease of viewing pocket insides), that are fused together by a thermal bond 80. For purposes of this discussion, each pocket 95 is formed by two pieces of fabric, of some construction including, but not limited to, non-woven, woven, knit, or needle punch that are bonded along the central axis of the spring 90 to form coil pocket 30. However, it is envisioned that the pocket spring can be formed of one or more fabrics that can be further bonded along either horizontal or vertical spring axes. In addition, the fabric bonding is not limited to thermal bonds, but might include, but is not limited to, stitch or glue bonding. Furthermore, the spring 90 is not limited to a barrel spring, but might also include a cone shaped, straight, or other suitable spring construction.

With continued reference to FIG. 1, surrounding pocket spring unit 30, on all sides is a fabric attachment layer 50. This attachment layer is made of a 50 gram per square meter non-woven fabric. However, the attachment layer can be made of other suitable fabrics such as, but not limited to, knits, wovens, needle punch and other suitable constructions. In addition, the fabric weight can be of any number of different weights subject to strength and flexibility considerations. Additionally, the attachment layer 50 is bonded to pocket spring units 30 by a water-based adhesive such as that can be sourced from either Simalfa, Hawthorne, N.J. 07506 USA or SABA North America LLC Kimball, Mich. 48074. However, it is envisioned that the adhesive can be, but is not limited to, a holt melt adhesive or a solvent based adhesive. The foam cushion element is approximately 2¼"× 2¼" with a height of approximately 2". The 2¼"×2¼" dimension roughly correlates to the 2¼" inch diameter of pocket spring unit 30. In this manner, it is possible to have a single foam cushion element 20 and single foam cushion element 25, each engaged with and acting only upon a single pocket spring unit 30. It should be obvious to one who is skilled in the art that the actual spring and foam dimensions can be varied without changing the functionality and utility of the pillow. The spacing and location of cushion elements 20 is such that each cushion element is located directly above a pocket spring unit 30 that it is directly acting upon, and a corresponding cushion element 25 is located directly below the same pocket spring unit 30 that it is directly acting upon.

Figure 2:
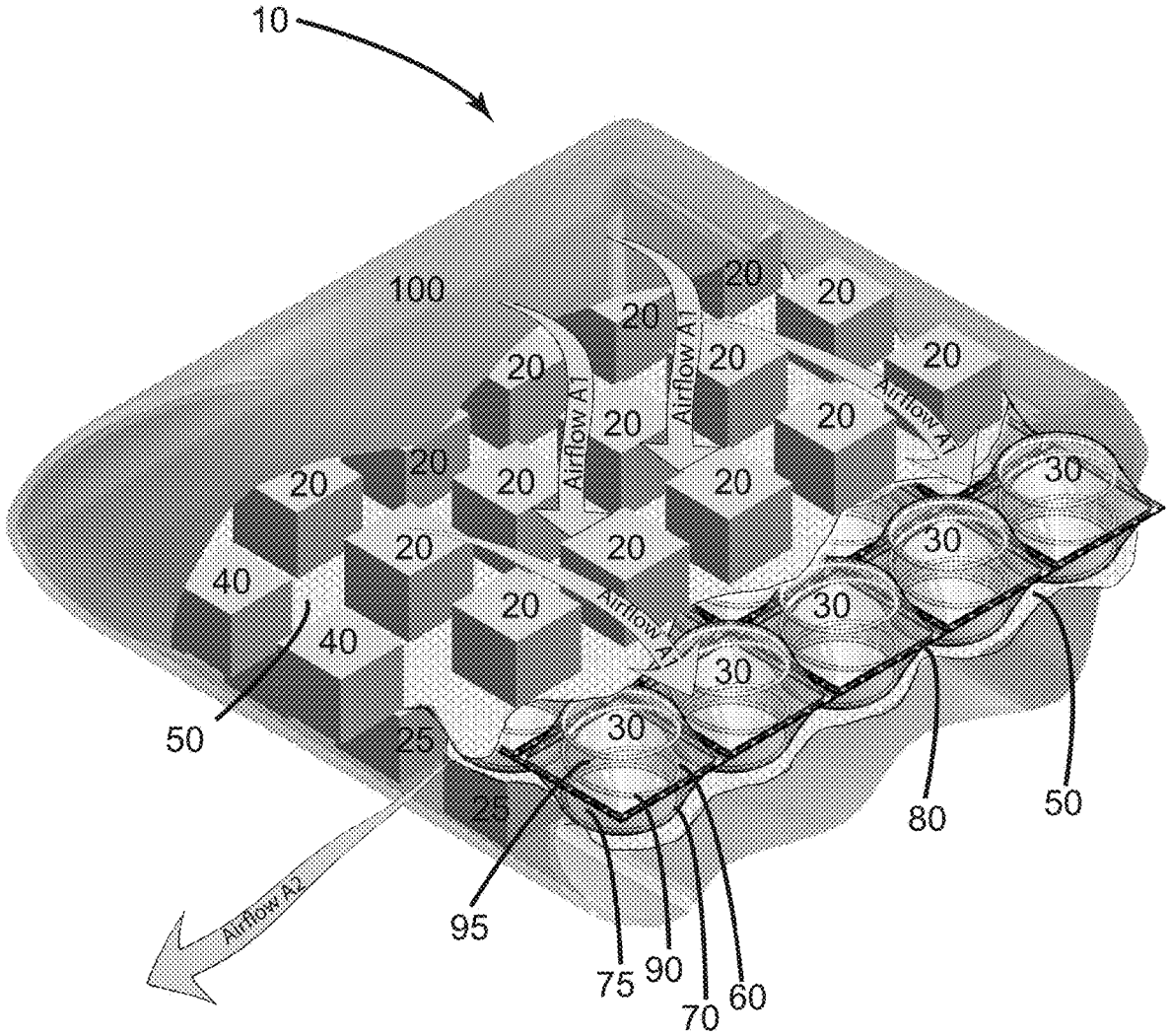
FIG. 2 is a cutaway perspective view of the pillow in an unloaded stated showing free standing cushion elements that allow air circulation around the cushion elements.

Referring to FIG. 2, attachment layer 50 provides the pillow with a lateral stability. Additionally, the attachment layer 50 provides a connection between the cushion layer above the pocket coil springs, containing cushion elements 20, with the cushion layer below the pocket coil springs, containing cushion elements 25. This connection adds to the stability of the pillow as well as imparting a counter force to lateral sleeper movements. For instance, if the sleeper shifts their head to the left imparting a lateral force to the cushions 20 above the pocket coil springs, the lateral forces transmitted thru the attachment layer force the cushions 25 below the pocket springs to shift to the right, thereby resisting having the pillow slide across the sleeping surface. This counterbalancing force has the added benefit of creating a very stable sleeping environment that minimalizes sleeper motions. At the same time, the attachment layer 50, provides for a method by which we can attach individual foam elements 20 and 25 to individual pocket coil springs. Furthermore, by first gluing the foam cushion elements to the attachment layer, and then adhering the attachment layer containing the foam elements to the pocket springs, or visa-versa, we can manufacture a pillow in which each foam element is engaged with its own pocket coil spring. At the same time, attachment layer 50 provides a means by which we can attach a side foam cushion 40, to pillow 10, and provide a mechanism to secure the individual side foam cushions 40 to the sides of pocket springs spring units 30 that will provide an out of plane cushion relative to the plane of pocket spring units 30 along the edges of pillow 10.

With continued reference to FIG. 2, air permeates the pillow cover 100 and is able to freely circulate between adjacent cushion elements 20 as indicated by passive airflow A1 that is occurring in the cushion layer above pocket spring units 30. At the same time, air permeates the pillow cover 100 and can freely circulate between adjacent cushion elements 25 as indicated by passive airflow A2 that is occurring in the cushion layer below pocket spring units 30. As a result, two passive airflow channels, A1 above pocket spring units 30 and A2 below pocket spring units 30 simultaneously allow air circulation to occur around the entire pillow. Unlike prior art type of conventional pillows, there are not one or more layers of poly foam that are stacked upon one another that act to block and restrict airflow into and out of the pillow cushion layer. Furthermore, unlike other prior art type of conventional pillows, randomly oriented fibers or foam blocks are not compressed together and reoriented so that they act to block and restrict airflow into and out of the pillow cushion layer.

Figure 3:
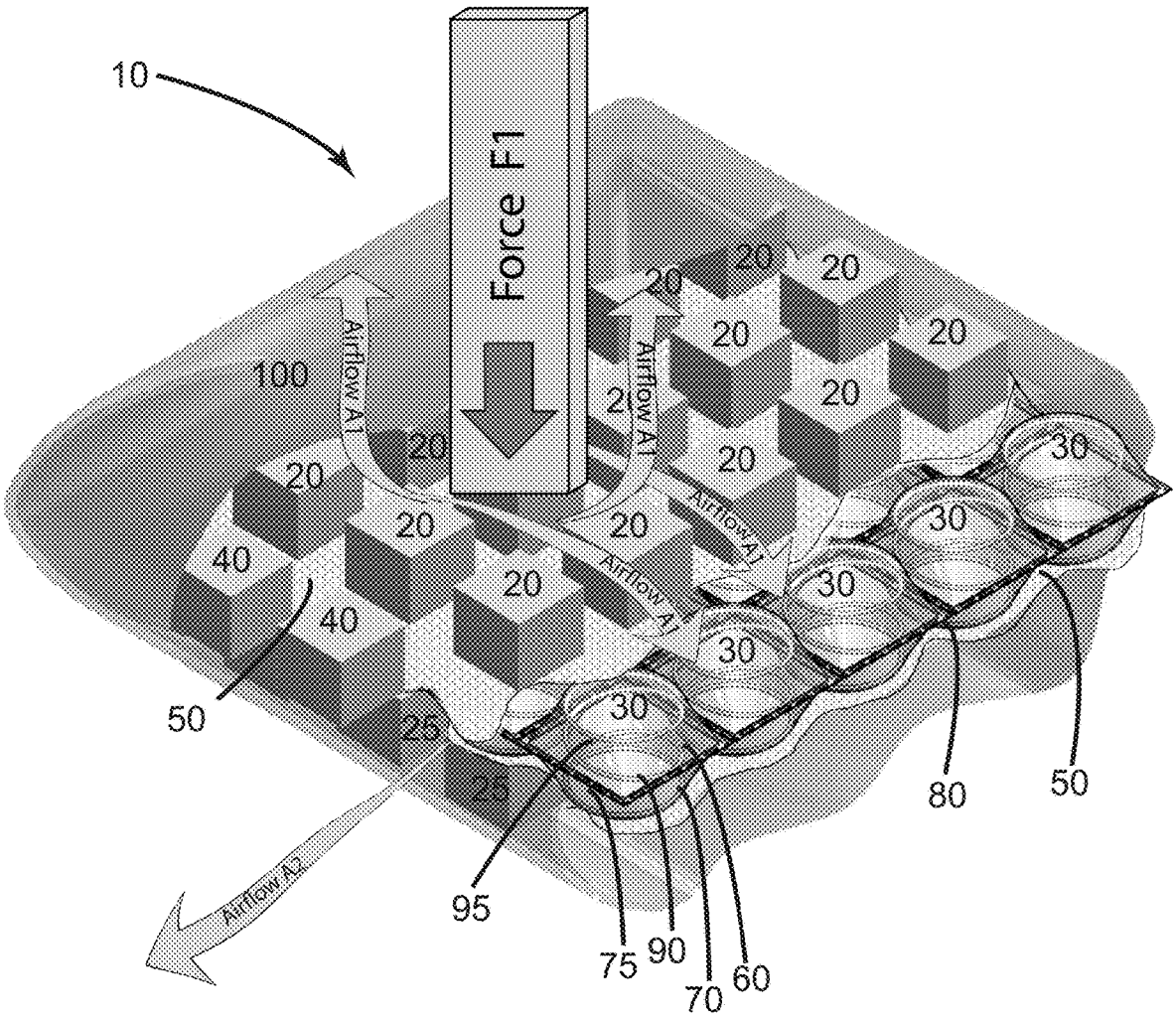
FIG. 3 is a cutaway perspective view of the pillow in a partially loaded state by a compressive force on one or more of the cushion pockets that results in a positive displacement of air around the cushion pockets.

Referring to FIG. 3, where pillow 10 is now subjected to an external compressive force F1 that creates the equivalent of a positive displacement air pump within the pillow. This pumping action induces eddy currents and airflows within the pillow cushion layers. Since the individual cushion elements 20 are not connected and air is allowed to freely flow throughout the cushion layer, a positively generated airflow A1, is generated in the cushion layer that resides above pocket spring units 30. At the same time, a positively generated airflow A2, is generated in the cushion elements 25 that resides below pocket spring units 30. As a result of a sleeper's head movement, the pillow acts as a positive displacement air pump both above and below the pocket coil layer and circulates air around the entire pillow 10.

Figure 4:
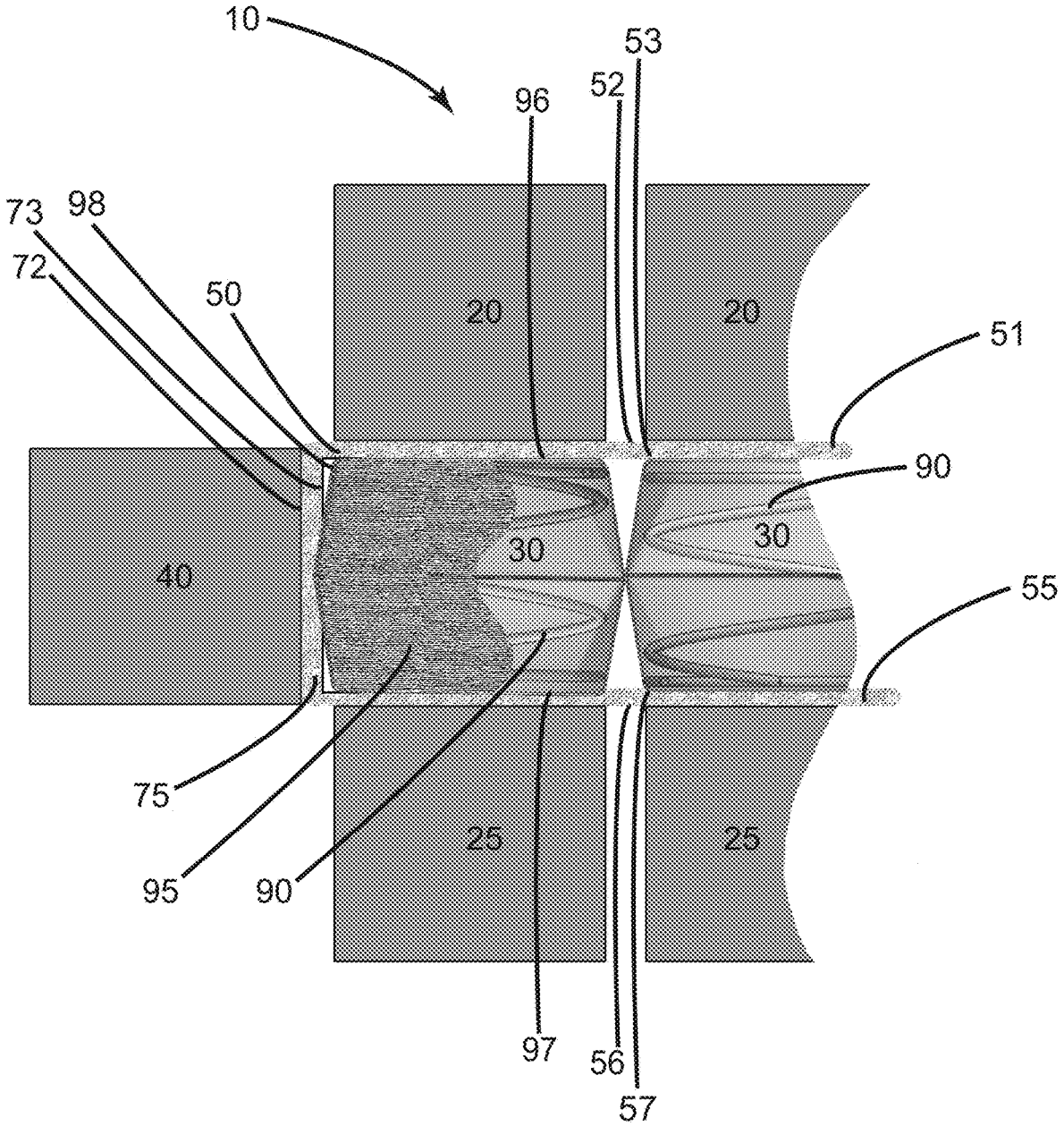
FIG. 4 is a cutaway end view of the pillow in an unloaded stated showing side cushion elements that are tangentially engaged with the side of coil pockets via an attachment layer that extends from below the upper cushion elements to the top of the bottom cushion elements that are engaged with the bottom of the same coil pockets.

Referring to FIG. 4, that shows a cutaway end view of pillow 10 in an unloaded stated, showing a cutaway view of pocket 95, an attachment layer 50 is shown as a continuous piece of fabric that enables the attachment of cushion element 20 to the top of pocket coil 30, then continues on to enable the attachment of side cushion element 40 to the side of the same pocket spring unit 30, then continues on to enable the connection of bottom cushion element 25 to the bottom of pocket spring unit 30. Also shown is that the attachment layer 50 continues on to provide an in plane lateral stability between each pocket spring unit 30, as well as providing an in plane lateral stability within the plane of cushion elements 20, as well an in plane lateral stability within the plane of cushion elements 25. Attachment layer 50 comprises an upper portion 51 having inner and outer surfaces 53 and 52; a bottom portion 55 having inner and outer surfaces 57 and 56; and a side portion 75 having inner and outer surfaces 73 and 72. Attached to the outer surface 52 of upper portion 51 of the attachment layer 50, is a foam cushion element 20 aligned with top portion 96 of pocket 95 of pocket spring unit 30. Attached to the outer surface 56 of lower portion 55 of the attachment layer 50, is a foam cushion element 25 aligned with bottom portion 97 of pocket 95 of pocket spring unit 30. Attached to the outer surface 72 of side portion 75 of the attachment layer 50, is a foam cushion element 40 aligned with side portion 98 of pocket 95 of pocket spring unit 30. It is further envisioned, to one skilled in the art, that the attachment layer could be made up of multiple sheets of fabric that are bonded together, via stitching, adhesive, thermal bond, or some other bonding agent, to act as a single continuous sheet. Furthermore, by first gluing the foam cushion elements 20 and 25 to the attachment layer 50, and then adhering the attachment layer containing the foam elements 20 and 25, to the pocket springs 30, or visa-versa, we can simplify the manufacture of the pillow.

Figure 5:
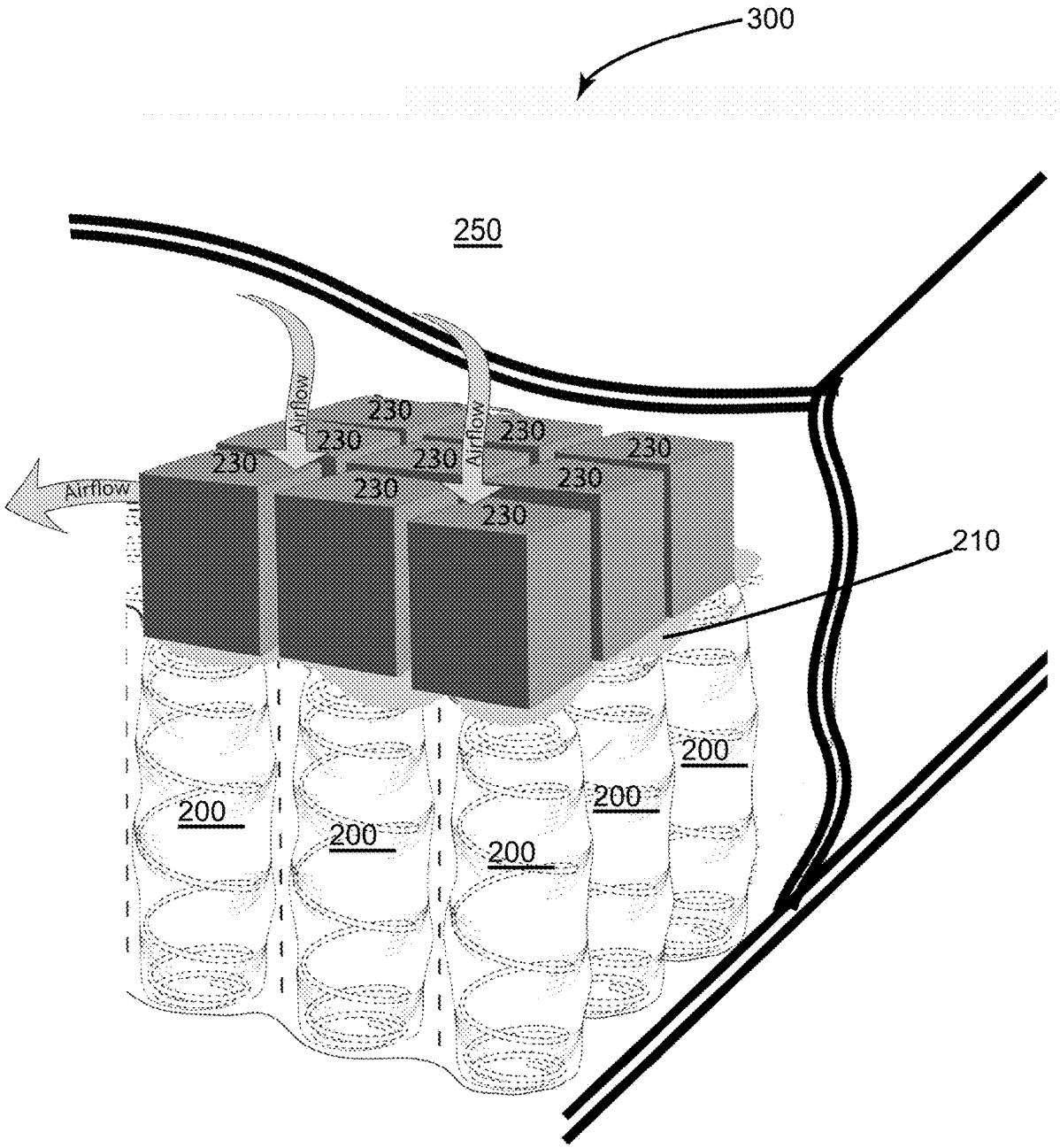
FIG. 5 is a cutaway perspective view of a mattress with cushion elements engaged with pocket coil springs via an attachment layer.

Referring to FIG. 5, where a cutaway perspective view of a mattress 300 is shown with cushion elements 230 engaged with pocket coil springs 200 via an attachment layer 210. The mattress has a fabric covering 250. Each of the cushion elements 230 is not covered by a pocket and is directly bonded to the upper surface of attachment layer 210 by a water-based adhesive, such as that can be sourced from either Simalfa, Hawthorne, N.J. 07506 USA or SABA North America LLC Kimball, Mich. 48074. However, it is envisioned that the adhesive can be, but is not limited to, a holt melt adhesive or a solvent based adhesive. The lower surface of attachment layer 210 is directly bonded to the pocket coil springs 200 by the aforementioned adhesive system.

Figure 6:
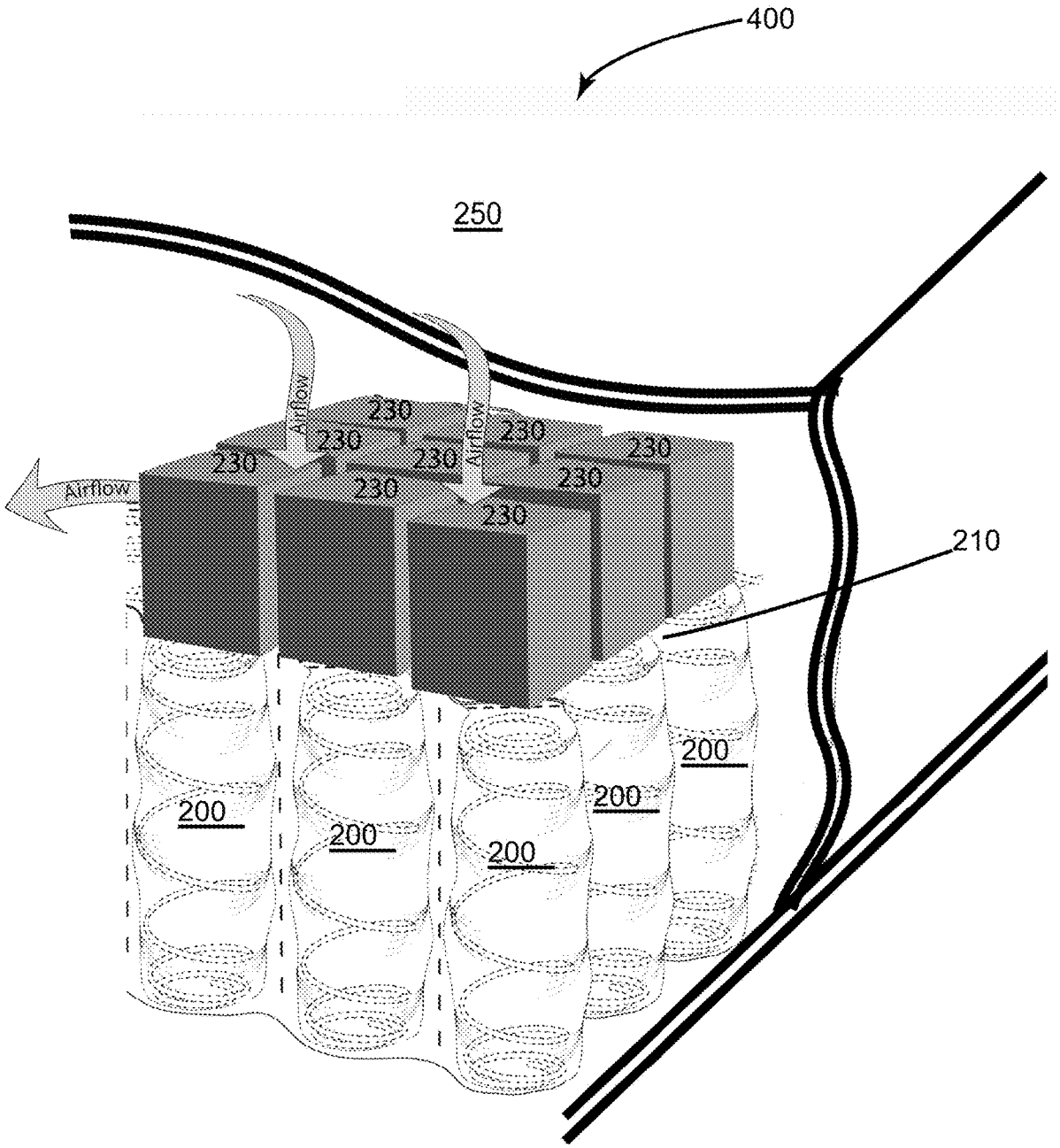
FIG. 6 is a cutaway perspective view of a mattress with cushion elements engaged directly with pocket coil springs.

Referring to FIG. 6, wherein a cutaway perspective view of a mattress 400 is shown with cushion elements 230 engaged directly with pocket coil springs 200 The mattress has a fabric covering 250. Each of the cushion elements 230 is not covered by a pocket and is directly bonded to the upper surface of pocket coil spring 200 by a water-based adhesive, such as that can be sourced from either Simalfa, Hawthorne, N.J. 07506 USA or SABA North America LLC Kimball, Mich. 48074. However, it is envisioned that the adhesive can be, but is not limited to, a holt melt adhesive or a solvent based adhesive.

While particular embodiments of the invention have been shown and described, it will be obvious to those skilled in the art that changes and modifications may be made without departing from the scope of the claimed invention.

What is claimed:

1. A pillow comprising:

a plurality of pocket spring units; each of said pocket spring units comprising a top portion, a bottom portion, and a side portion;

an attachment layer comprising a top portion comprising an outer surface and a lower inner surface; and a plurality of first cushion elements engaged with said outer surface of said top portion of said attachment layer; said inner surface of said top portion of said attachment element being engaged with said top portion of said plurality of pocket spring units such that each of said first cushion elements act only upon one of said pocket spring units.

2. The pillow of claim 1, wherein said attachment layer further comprises a bottom portion comprising an outer surface and an inner surface; the pillow further comprising a plurality of second cushion elements engaged with said outer surface of said bottom portion of said attachment layer; said inner surface of said bottom portion of said attachment layer being engaged with said bottom portion of said plurality of pocket spring units such that each of said second cushion elements act only upon one of said pocket spring units.

3. The pillow of claim 2, wherein said attachment layer further comprises a side portion comprising an outer surface and an inner surface; the pillow further comprising a plurality of third cushion elements engaged with said outer surface of said side portion of said attachment layer; said inner surface of said side portion of said attachment layer being engaged with said side portion of said plurality of pocket spring units such that each of said third cushion elements act only upon one of said pocket spring units.

4. The pillow of claim 3, wherein said top portion, said bottom portion and said side portion of said attachment layer are made from a single piece of material.

5. The pillow of claim 3, wherein each of said first cushion elements, said second cushion elements, and said third cushion elements are made from a foam material.

6. The pillow of claim 3, wherein said first cushion elements are attached to said outer surface of said top portion of said attachment layer by adhesive.

7. The pillow of claim 3, wherein said second cushion elements are attached to said outer surface of said bottom portion of said attachment layer by adhesive.

8. The pillow of claim 3, wherein said third cushion elements are attached to said outer surface of said side portion of said attachment layer by adhesive.

* * * * *